US012576305B2

(12) United States Patent
Agostini

(10) Patent No.: US 12,576,305 B2
(45) Date of Patent: Mar. 17, 2026

(54) EXERCISE DEVICE

(71) Applicant: Scott C. Agostini, San Juan Capistrano, CA (US)

(72) Inventor: Scott C. Agostini, San Juan Capistrano, CA (US)

( * ) Notice: Subject to any disclaimer, the term of this patent is extended or adjusted under 35 U.S.C. 154(b) by 0 days.

(21) Appl. No.: 18/495,509

(22) Filed: Oct. 26, 2023

(65) Prior Publication Data

US 2025/0135274 A1 May 1, 2025

(51) Int. Cl.
*A63B 22/18* (2006.01)

(52) U.S. Cl.
CPC ..... *A63B 22/18* (2013.01)

(58) Field of Classification Search
CPC ..... A63B 22/18; A63B 22/20; A63B 26/003; A63B 23/1236; A63B 21/0004; A63B 21/4035; A63B 21/4043; A63B 22/203; A63B 23/0355; A63B 21/068; A63B 22/16; A63B 21/0618; A63B 22/14; A63B 22/201–208; A63B 19/00; A63B 19/02; A63B 19/04; A63B 2022/185; A63B 2022/206; A63B 21/00; A63B 21/00069; A63B 21/0608; A63B 21/22; A63B 21/222; A63B 21/4023; A63B 21/4049; A63B 22/205; A63B 22/208; A63B 5/16; A63B 5/166
See application file for complete search history.

(56) References Cited

U.S. PATENT DOCUMENTS 600,172 A 3/1898 Frank
1,824,920 A 9/1931 Novak
D134,341 S 11/1942 Churchill
3,024,021 A 3/1962 Coplin et al.
3,262,701 A 7/1966 Howland
3,306,626 A * 2/1967 Kawada ..... A63C 17/24 482/77
3,379,454 A 4/1968 Woodman
3,604,726 A 9/1971 Tracy
3,622,152 A 11/1971 Place
3,716,229 A 2/1973 Van Der Cleyen et al.
(Continued)

FOREIGN PATENT DOCUMENTS

KR 20130067625 A 6/2013

OTHER PUBLICATIONS

International Search Report, dated Sep. 21, 2012, 2 pages.
(Continued)

*Primary Examiner* — Megan Anderson
*Assistant Examiner* — Catrina A Letterman
(74) *Attorney, Agent, or Firm* — Stetina Garred Brucker & Newboles

(57) ABSTRACT

A rolling-type exercise device includes a base having a central opening formed therein. A plurality of bearing assemblies are operatively coupled to the base. Each bearing assembly includes a pair of bearing supports and a bearing axle extending between the pair of bearing supports and being coupled to the pair of bearing supports so as to facilitate rotation of the bearing axle relative to the base. A roller operatively interfaces each bearing axle of the plurality of bearing assemblies and at least partially protruding through the central opening, the roller being configured to rotate relative to the base within the central opening.

20 Claims, 9 Drawing Sheets

(56) References Cited

U.S. PATENT DOCUMENTS 3,806,116 A 4/1974 Bornell et al.
3,862,768 A 1/1975 England
3,895,794 A 7/1975 England
3,995,873 A 12/1976 Pantzar
4,116,233 A 9/1978 Scaduto
4,191,371 A 3/1980 Armer, Jr.
4,193,592 A 3/1980 Bishow
4,491,318 A 1/1985 Francke
4,509,743 A 4/1985 Lie
4,605,224 A 8/1986 Torii
4,653,748 A 3/1987 Seel et al.
4,759,542 A 7/1988 Hudec
4,826,159 A 5/1989 Hersey
5,092,586 A 3/1992 Tuthill et al.
5,358,463 A * 10/1994 Fuentes ..... A63B 23/12 482/141
5,509,871 A 4/1996 Giovanni
5,603,334 A 2/1997 Sharp
5,613,690 A * 3/1997 McShane ..... G06F 3/0334 428/902
5,632,707 A 5/1997 Daniel et al.
5,647,830 A 7/1997 Togao
5,735,776 A 4/1998 Swezey et al.
5,810,703 A 9/1998 Stack
5,833,588 A 11/1998 Connelly, III et al.
5,897,474 A 4/1999 Romero
6,019,712 A 2/2000 Duncan
D428,454 S 7/2000 Fischer et al.
6,428,451 B1 8/2002 Hall
D469,831 S 2/2003 Tuccillo
6,652,421 B1 11/2003 Chen
6,773,379 B1 8/2004 Bing
6,945,920 B1 9/2005 Kemery et al.
7,264,580 B2 9/2007 Lu
D552,696 S 10/2007 Hallar
7,300,392 B1 11/2007 Curran
D564,604 S 3/2008 Mikail
7,357,767 B2 4/2008 Tsai
7,500,324 B1 3/2009 Power et al.
7,621,858 B2 11/2009 Sheron
7,632,218 B2 12/2009 Sannes et al.
D612,896 S 3/2010 Talley
7,678,027 B2 3/2010 Sanghavi
7,775,952 B1 8/2010 Curran et al.
7,806,807 B2 10/2010 Genua
D627,015 S 11/2010 Senegal
7,883,452 B1 2/2011 Chen
7,942,796 B2 5/2011 Signorile et al.
7,981,016 B1 7/2011 Howard
D660,928 S 5/2012 Guarrasi
8,353,808 B1 1/2013 Barney
D681,738 S 5/2013 Richmond
8,550,965 B2 10/2013 Candela et al.
8,702,574 B2 4/2014 Abranchess
8,827,879 B2 9/2014 Nicholas
8,944,979 B2 2/2015 Kulzer
9,079,072 B2 7/2015 Agostini
D738,444 S 9/2015 Hilson
9,199,117 B1 12/2015 Nicholas
9,216,321 B2 12/2015 Agostini
D749,178 S 2/2016 Nicholas
9,327,155 B2 5/2016 Doyle
9,539,465 B2 1/2017 Agostini
9,700,756 B2 7/2017 Franche
9,750,980 B1 9/2017 Khalili
9,782,116 B2 10/2017 Lonis
D803,217 S 11/2017 Bonora et al.
9,878,199 B2 1/2018 Agostini
11,819,731 B2 * 11/2023 Panes ..... A63B 23/0216
2002/0025894 A1 * 2/2002 Fernandez ..... A63B 21/0004 482/140
2004/0009859 A1 1/2004 Gottlieb
2004/0018924 A1 1/2004 Szydlowski et al.
2004/0142802 A1 * 7/2004 Greenspan ..... A61H 1/0237 482/146
2005/0209072 A1 9/2005 Sheron
2006/0211553 A1 9/2006 Cantor
2007/0254789 A1 11/2007 Odien
2007/0298947 A1 12/2007 Eksteen
2009/0325770 A1 12/2009 Baschnagel
2010/0087301 A1 4/2010 Juncker
2010/0261590 A1 10/2010 Fares
2010/0331154 A1 12/2010 Taylor et al.
2011/0143896 A1 6/2011 Senegal
2011/0160024 A1 6/2011 Candela et al.
2011/0251033 A1 10/2011 Blancher
2012/0252645 A1 10/2012 Agostini
2012/0264579 A1 10/2012 Klein et al.
2013/0017937 A1 1/2013 Guarrasi
2013/0237395 A1 9/2013 Hjelt et al.
2013/0281273 A1 10/2013 Susnjara
2013/0316884 A1 * 11/2013 Gobeil ..... A63B 21/068 482/141
2014/0121082 A1 5/2014 Kramer et al.
2014/0162859 A1 6/2014 Cheng
2014/0194265 A1 7/2014 Torres
2014/0371041 A1 12/2014 Terpstra et al.
2015/0011369 A1 1/2015 Peritz
2015/0209612 A1 * 7/2015 Shen ..... A63B 21/15 482/147
2018/0093129 A1 4/2018 Agostini
2018/0185702 A1 7/2018 Brown
2021/0331030 A1 * 10/2021 Person ..... A63B 23/1236
2021/0394012 A1 12/2021 Agostini

OTHER PUBLICATIONS http://www.fitforallball.com/, 2012, 2 pages.
FEWDM; OmniBall; website https://fewdm.com/shop/omniball/; Nov. 2, 2015; 4 pages.
Aileensheron.com; OmniBall; website http://aileensheron.com/omniball/; Nov. 2, 2015; 3 pages.
Thomas, Shane; PCT International Search Report and Written Opinion; PCT/US2024/052783; dated Jan. 24, 2025; 12 pages.

* cited by examiner

EXERCISE DEVICE

CROSS-REFERENCE TO RELATED APPLICATIONS

Not Applicable

STATEMENT RE: FEDERALLY SPONSORED RESEARCH/DEVELOPMENT

Not Applicable

BACKGROUND

Technical Field

The present disclosure relates generally to exercise devices, and more specifically, to an exercise device including a ball mounted to a user engagement surface to facilitate 360° freedom of movement of the exercise device.

Description of the Related Art

It is well-known that routine exercise is good for both the body and mind. Along these lines, each community typically includes a gym or fitness center where individuals can access a wide variety of exercise equipment. Although such gyms and fitness centers may facilitate routine exercise for certain individuals, there are various drawbacks associated with gyms and fitness centers. One drawback is that the gyms/fitness centers generally require membership for access into their facilities. The membership agreements may require a long-term commitment from the individual, which may add up to a significant expense for the individual. Another drawback is that it may be difficult for some individuals to make time in their day-to-day schedules to go to the gyms/fitness centers.

Therefore, various home-fitness machines have been developed to allow individuals to exercise within the comfort of their own home. Certain home-fitness machines are "universal" in nature, and allow an individual to exercise multiple muscle groups. However, such "universal" machines tend to be very large and very expensive. Other home-fitness machines are smaller and tend to focus on one particular muscle or muscle group.

Many of the smaller fitness devices tend to be of the "roller" variety, wherein a user rolls the device forward and backward along a planar surface to conduct the exercise. The device may include a wheel and handles for the user to grasp. The user may kneel on his knees and extend his torso away from his knees, and then back toward his knees, with the roller rolling forward and backward to facilitate such motion. The foregoing exercise may workout the user's core, especially the abdominal muscles and back muscles.

Although the smaller fitness devices may provide a suitable alternative to full-fledged gym memberships discussed above, there are certain features that are common to conventional roller-type exercise devices which detract from their overall utility. One drawback is that the devices are generally limited to a rolling motion along a single axis. In other words, the devices roll forward and backward along a common axis, and are not capable of rolling from side-to-side. Such side-to-side motion would be desirable to allow for a more circular exercise motion to work out more muscle groups. Another drawback is that conventional roller-type exercise devices may include elaborate structural features to facilitate rolling of the device, which may be difficult to manufacture, and may produce undesirable loud noise during use.

Therefore, in view of the foregoing, there is a need in the art for a personal exercise device that offers a broader range of motion compared to traditional roller-type exercise devices, while also providing smooth, quiet rolling. The present disclosure addresses this particular need, as explained in the following sections and as shown in the accompanying drawings.

BRIEF SUMMARY

According to one embodiment, there is provided an exercise device comprising a base having a central opening formed therein. A plurality of bearing assemblies are operatively coupled to the base. Each bearing assembly includes a pair of bearing supports and a bearing axle extending between the pair of bearing supports and being coupled to the pair of bearing supports so as to facilitate rotation of the bearing axle relative to the base. A roller operatively interfaces each bearing axle of the plurality of bearing assemblies and at least partially protruding through the central opening, the roller being configured to rotate relative to the base within the central opening.

The exercise device may include a bearing retainer coupled to the base and configured to be engageable to the plurality of bearing assemblies.

The plurality of bearing assemblies may include three bearing assemblies or four bearing assemblies.

Each bearing axle may be cylindrical with a generally uniform outer diameter.

The bearing axle may include a pair of end portions and a central portion, with the central portion having a reduced diameter relative to the pair of end portions.

The bearing axle may include a pair of end portions and a central portion, with the central portion having an increased diameter relative to the pair of end portions.

The bearing axle may include a pair of end portions and a central portion, with the central portion including a pair of increased diameter bodies protruding radially outward from an intermediate reduced diameter section.

A portion of the roller may be configured to be concealed within base while a remaining portion extends from base.

The exercise device may include a brake operatively engageable with the roller and configured to selectively impart a force on the roller to inhibit movement of the roller relative to the base.

According to another embodiment, there is provided an exercise device comprising a base having a central opening formed therein. A plurality of bearing axles are configured to be rotatable relative to the base, with each bearing axle having an elongate configuration and extending along a respective axle axis. A roller operatively interfaces each bearing axle and is configured to at least partially protrude through the central opening, the roller being configured to rotate relative to the base within the central opening.

The exercise device may include a bearing retainer coupled to the base and configured to facilitate interconnection of the plurality of bearing axles to the base.

The present disclosure is best understood by reference to the following detailed description when read in conjunction with the accompanying drawings.

BRIEF DESCRIPTION OF THE DRAWINGS

These, as well as other features of the present disclosure will become more apparent upon reference to the drawings wherein.

Common reference numerals are used throughout the drawings and detailed description to indicate like elements.

DETAILED DESCRIPTION

Figure 1:
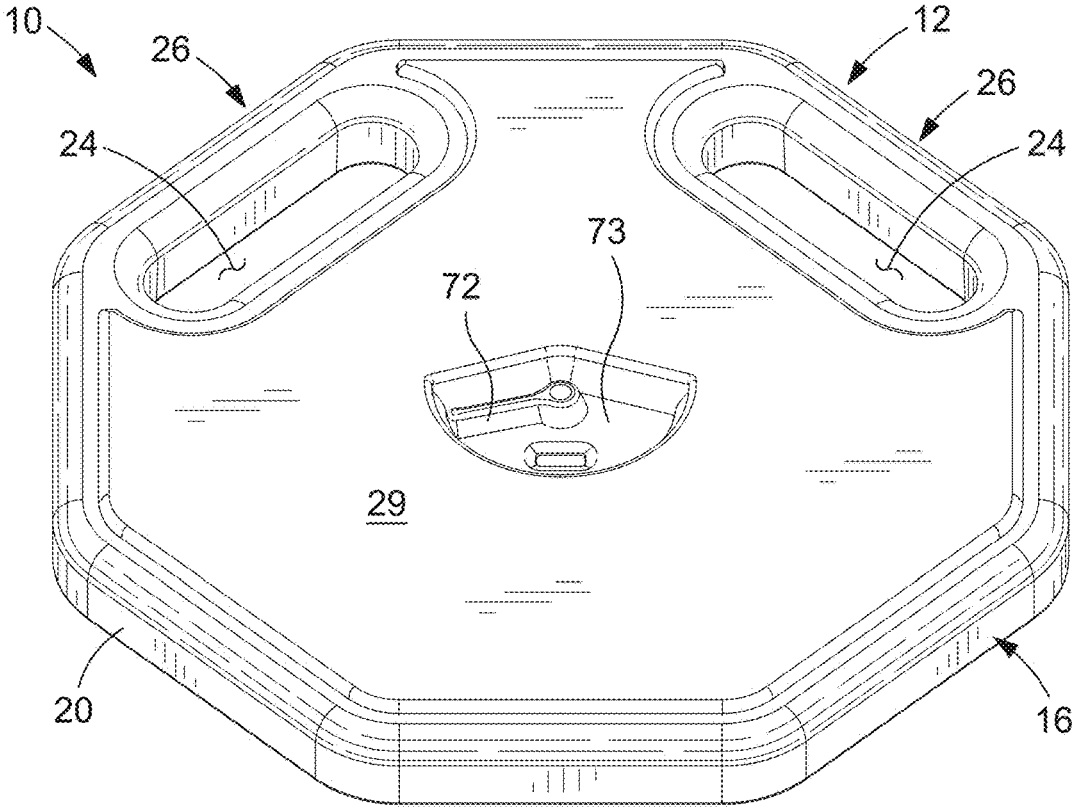
FIG. 1 is an upper perspective view of an embodiment of an exercise device.
Figure 2:
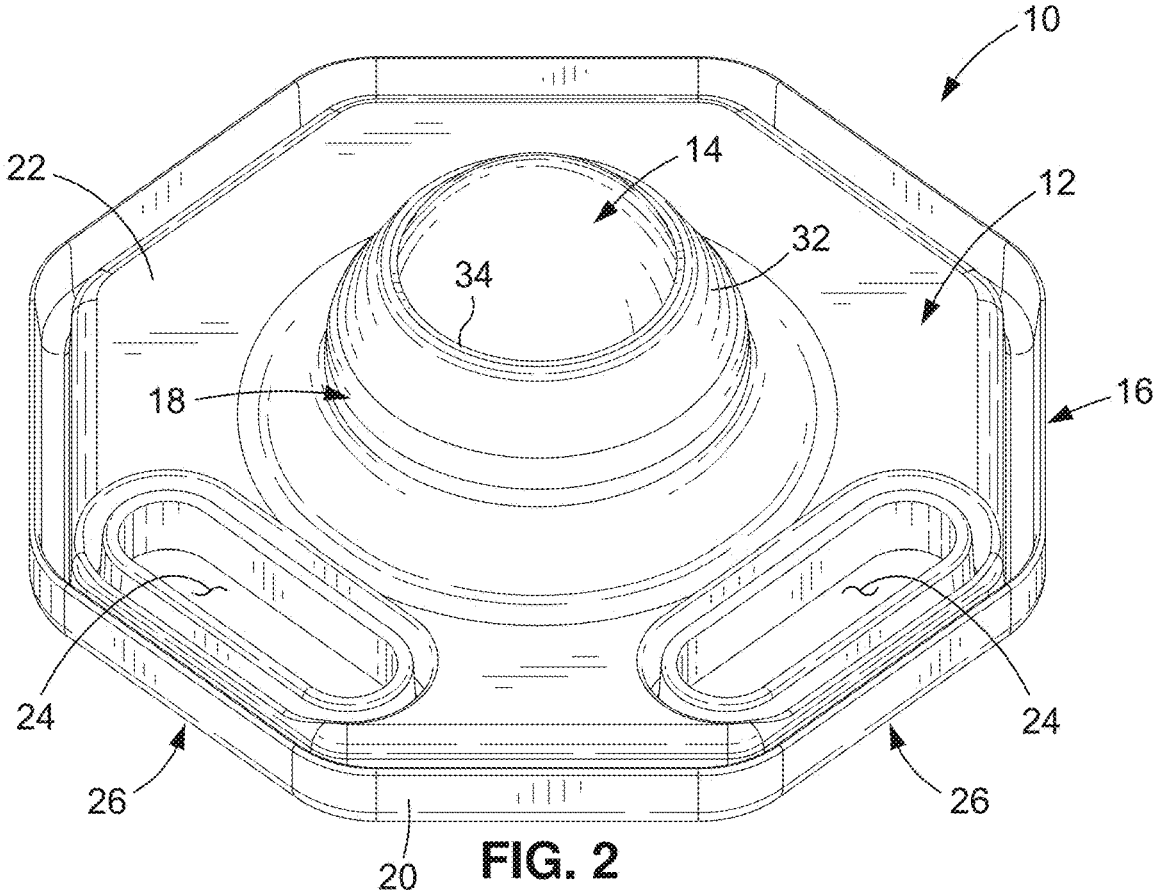
FIG. 2 is a lower perspective view of the exercise device.
Figure 3:
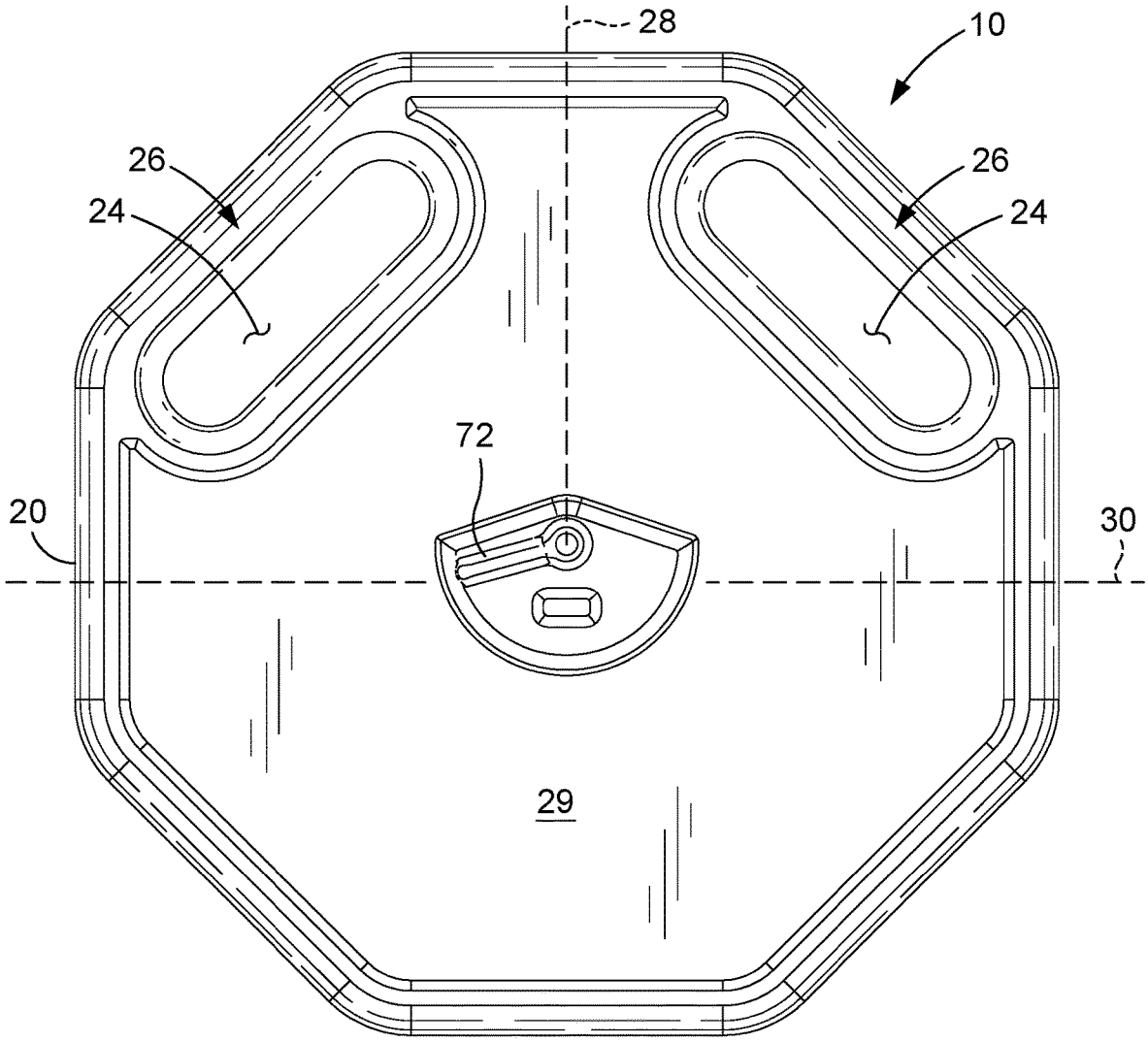
FIG. 3 is a top view of the exercise device.
Figure 4:
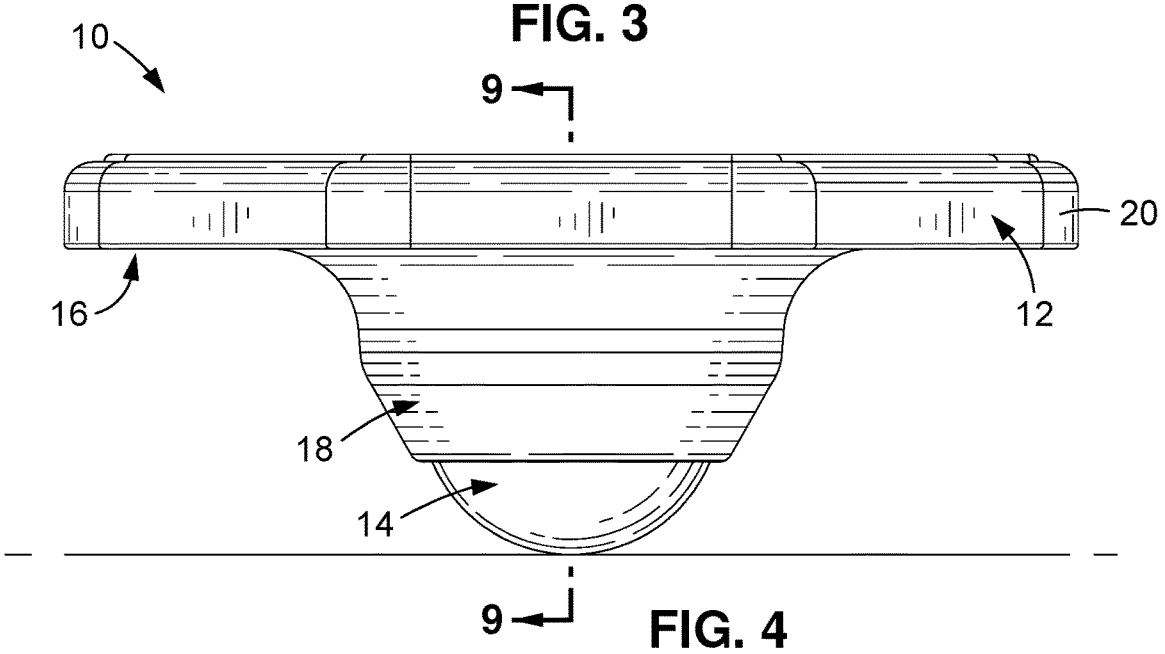
FIG. 4 is a side view of the exercise device.

The detailed description set forth below in connection with the appended drawings is intended as a description of certain embodiments of an exercise device and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Referring now to the drawings where the showings are for purposes of illustrating certain aspects of the present disclosure, and are not for purposes of limiting the same, there is depicted an exercise device 10 configured to roll over a surface to work out various muscle groups, such as the abdominal muscles and back muscles. The exercise device 10 includes a unique roller bearing assembly which allows for smooth quiet 360-degree motion of the exercise device 10 over an underlying surface.

Figure 9:
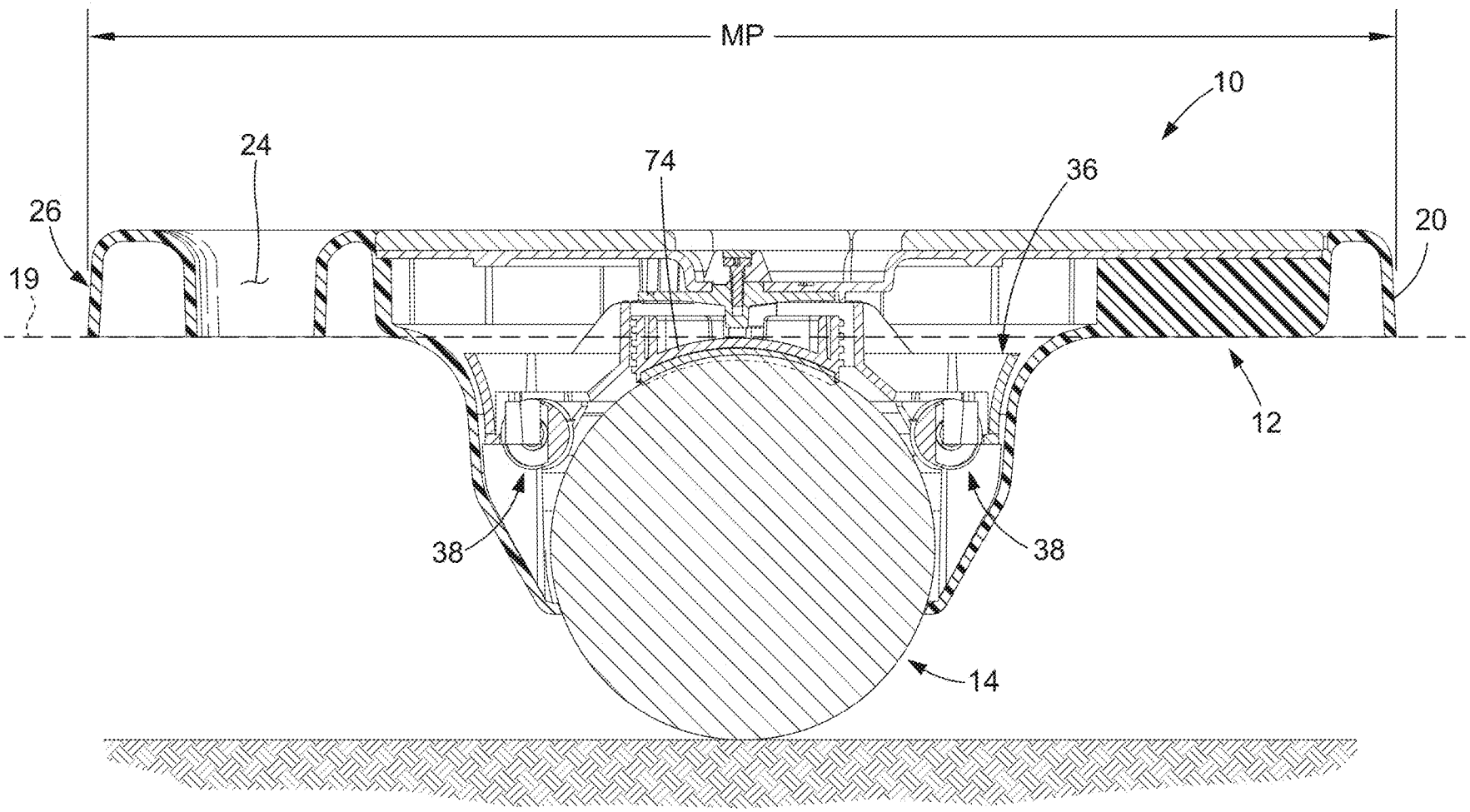
FIG. 9 is a side sectional view of the exercise device.
Figure 10:
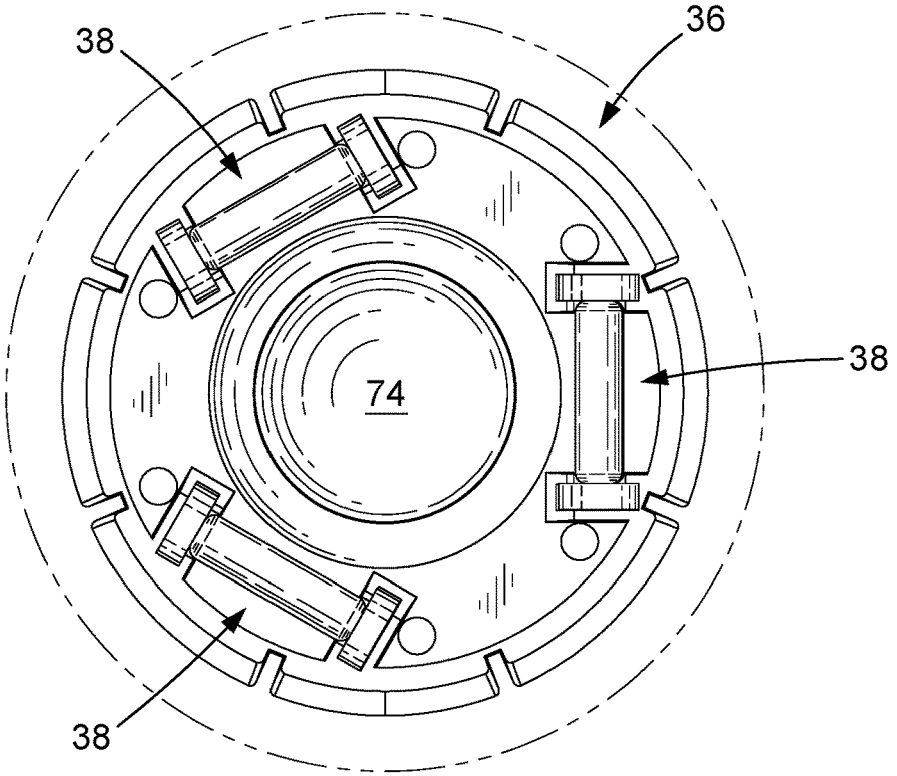
FIG. 10 is a bottom view of the bearing retainer and three bearing assemblies coupled thereto.
Figure 11:
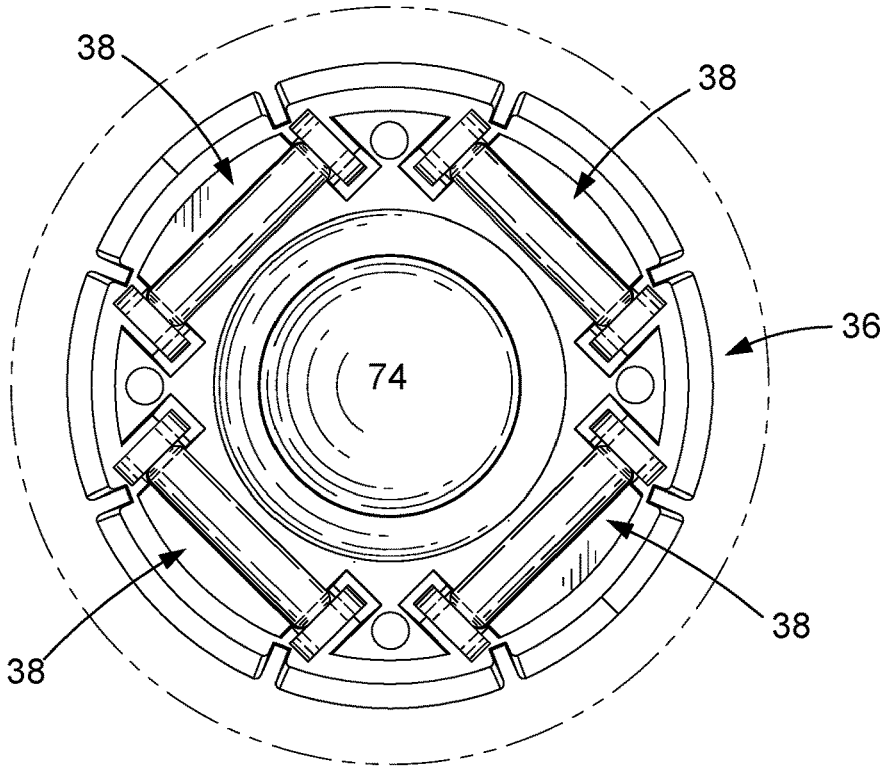
FIG. 11 is a bottom view of the bearing retainer and four bearing assemblies coupled thereto.

FIGS. 1-4 depict one embodiment of the exercise device 10, which generally includes a base 12, a roller 14, and an internal bearing assembly to facilitate smooth rotation of the roller 14 relative to the base 12. The base 12 may be sized to accommodate the internal components of the device 10, while also being sized and configured to interface with a user. In one embodiment, the base 12 may include a user engagement portion 16 and a roller retaining portion 18. The user engagement portion 16 may be generally positioned above the roller retaining portion 18 and some of the user engagement portion 16 may extend radially outward relative to the roller retaining portion 18. In this regard, the base 20 may define a maximum outer periphery MP (see FIG. 9) within a plane 19 spaced from the roller 14 such that the roller 14 does not protrude through the plane 19. The user engagement portion 16 may include a peripheral sidewall 20 and a main wall 22 positioned between the peripheral sidewall 20 and the roller retaining portion 18. The main wall 22 includes a generally planer lower surface and a plurality of support ribs 25 (see FIG. 5) or trusses extending from the lower surface to enhance the overall strength of the base 12 to enable support of a weight of the user. Certain support ribs 25 may be configured in a ring-like configuration, with multiple support rings being concentrically disposed about a central opening 23 (See FIGS. 5-6), which may be sized to receive the roller 14, as will be explained in more detail below. Other support ribs 25 may be generally planar and may extend radially outwardly relative to the central opening 23 and may intersect with multiple support rings. The support ribs 25 may define a plurality of voids or cavities within the base 12 which may be filled with sound dampening foam inserts.

In one embodiment, the user engagement portion 16 may include a plurality of handle openings 24 positioned adjacent the sidewall 20 to form a plurality of handles 26. In the exemplary embodiment, the device 10 includes a pair of handles 26 positioned on opposite sides of mid line 28, but on the same side of midline 30. Although two handles 26 are shown in the embodiment depicted in the figures, it is contemplated that other embodiments may include more than two handles 26, such as four handles 26, without departing from the spirit and scope of the present disclosure.

The roller retaining portion 18 may include a tapered wall 32 (e.g., a roller retaining wall) that extends from the lower surface of the main wall 22. In one embodiment, the tapered wall 32 may be integrally formed with the main wall 22. A diameter of the tapered wall 32 maybe greatest adjacent the lower surface of the main wall 22. The tapered wall 32 may be configured to extend away from the lower surface of the main wall 22 such that the diameter of the tapered wall 32 decreases as the tapered wall 32 extends away from the lower surface of the main wall 22. The tapered wall 32 may terminate at a distal most edge 34, which may define a minimum diameter of the tapered wall 32. The minimum diameter of the tapered wall 32 may be less than an outer diameter of the roller 14. In this respect, the configuration of the tapered wall 32 may allow a portion of the roller 14 to protrude beyond the distal most edge 34, while also being retained within the tapered wall 32, e.g., the entirety of the roller 14 May not pass beyond the distal most edge 34.

A cover plate 27 may be coupled to the base 12 to extend over portions of the user engagement portion 16 and the roller retaining portion 18. In particular, the cover plate 27 may be sized to be coupled to the base 12 to cover the roller 14, the related bearing assembly, and any foam inserts placed within the base 12 and around the roller 14 to minimize sound. The cover plate 27 may be configured to extend around the handle openings 24 and to fit within the periphery of the sidewall 20. A cover pad 29 may be coupled to the cover plate 27 to provide a more comfortable surface on which the user may stand or lean against during use.

Figure 5:
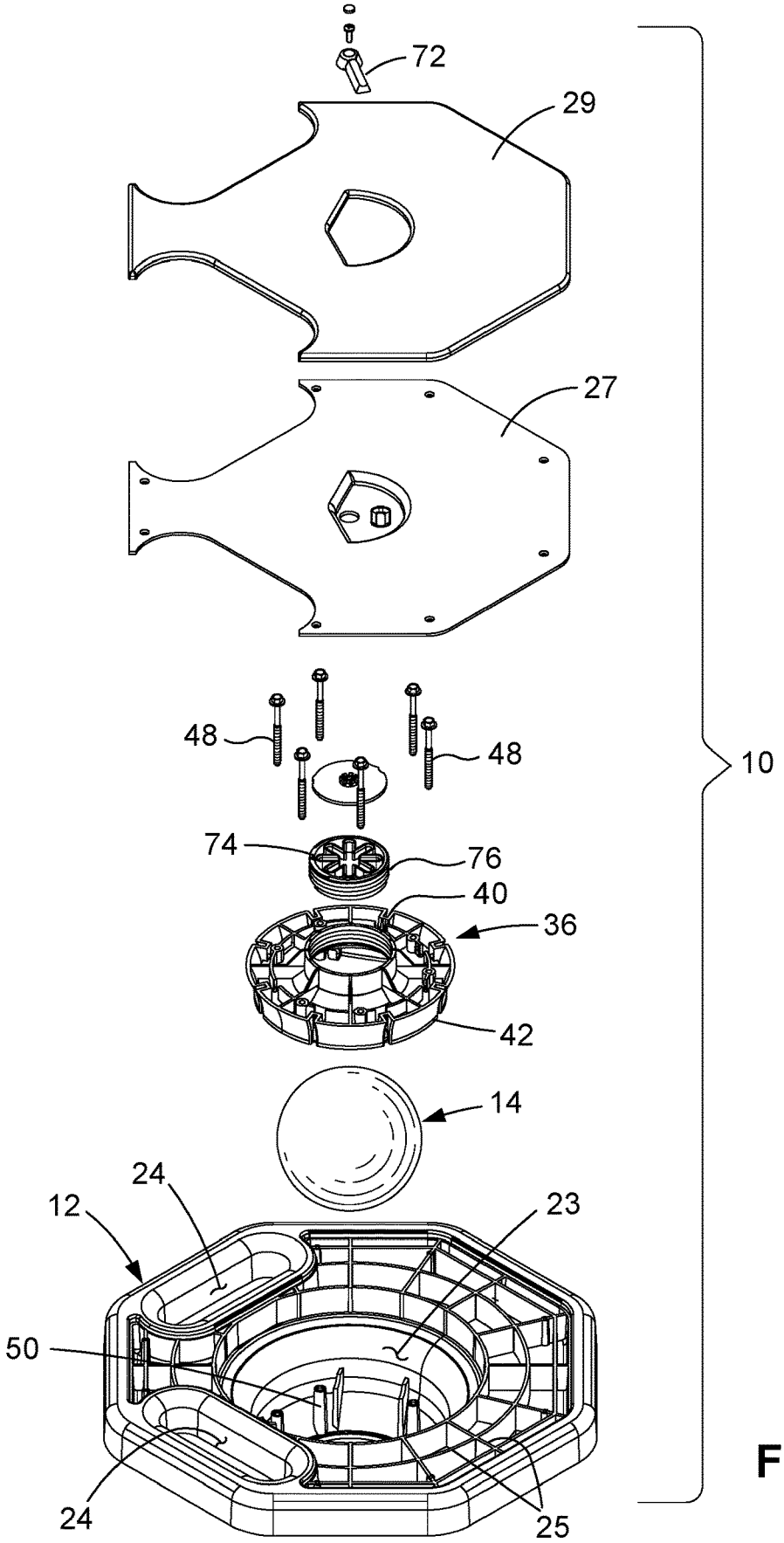
FIG. 5 is an exploded upper perspective view of the exercise device.
Figure 6:
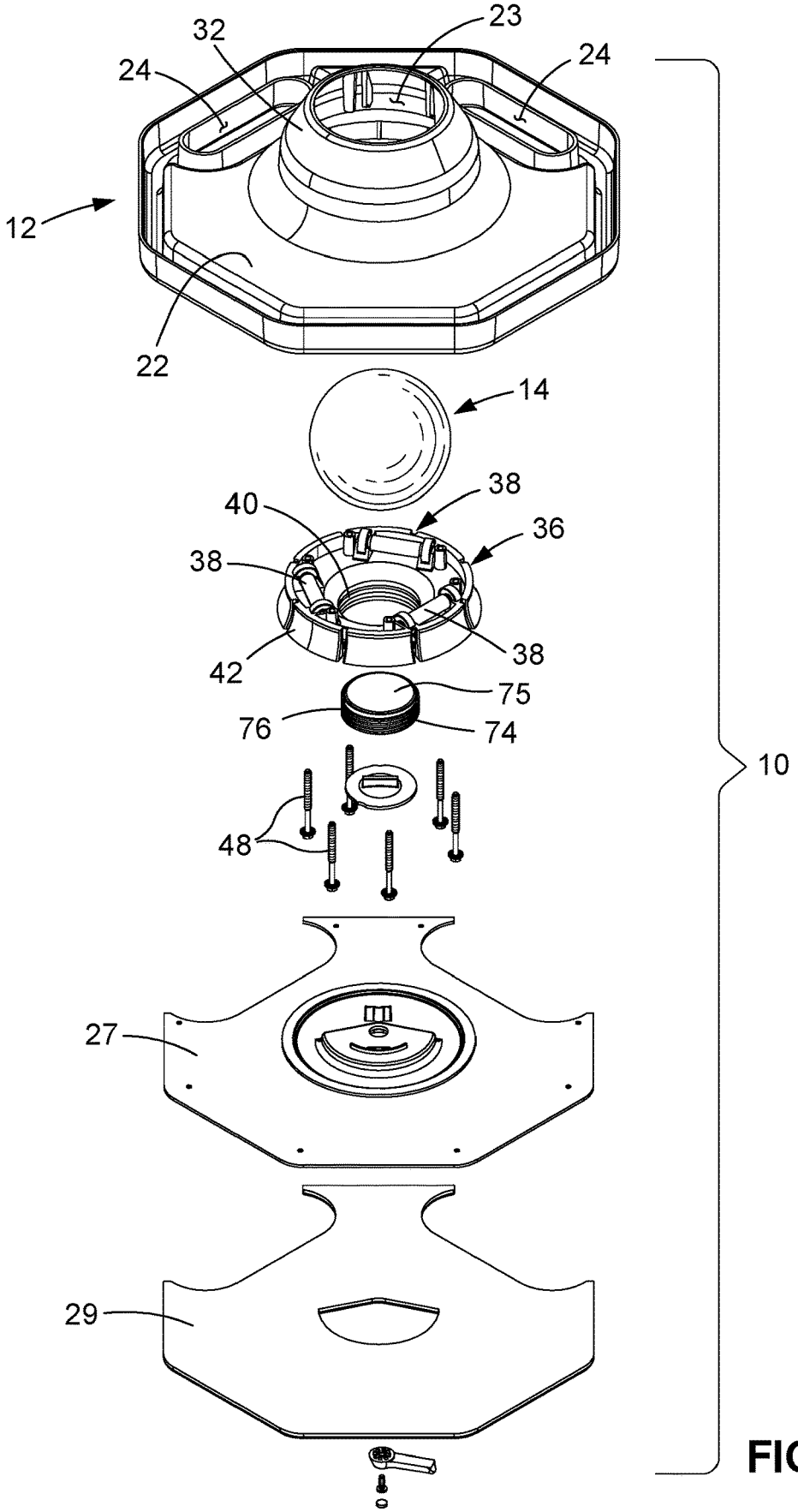
FIG. 6 is an exploded lower perspective view of the exercise device.
Figure 7:
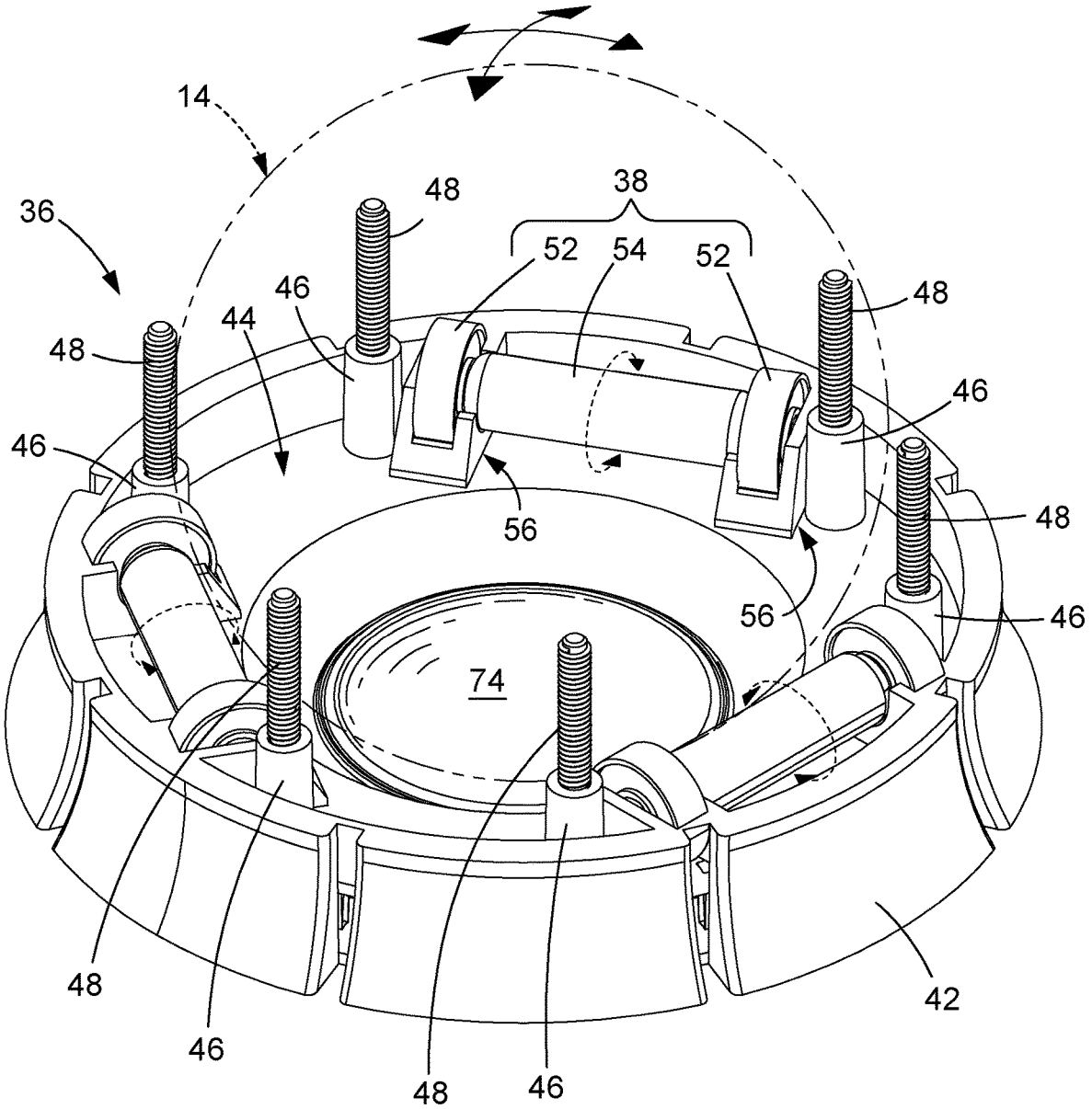
FIG. 7 is a perspective view of a plurality of bearing assemblies coupled to a bearing retainer and configured to interface with a roller depicted in phantom.
Figure 8:
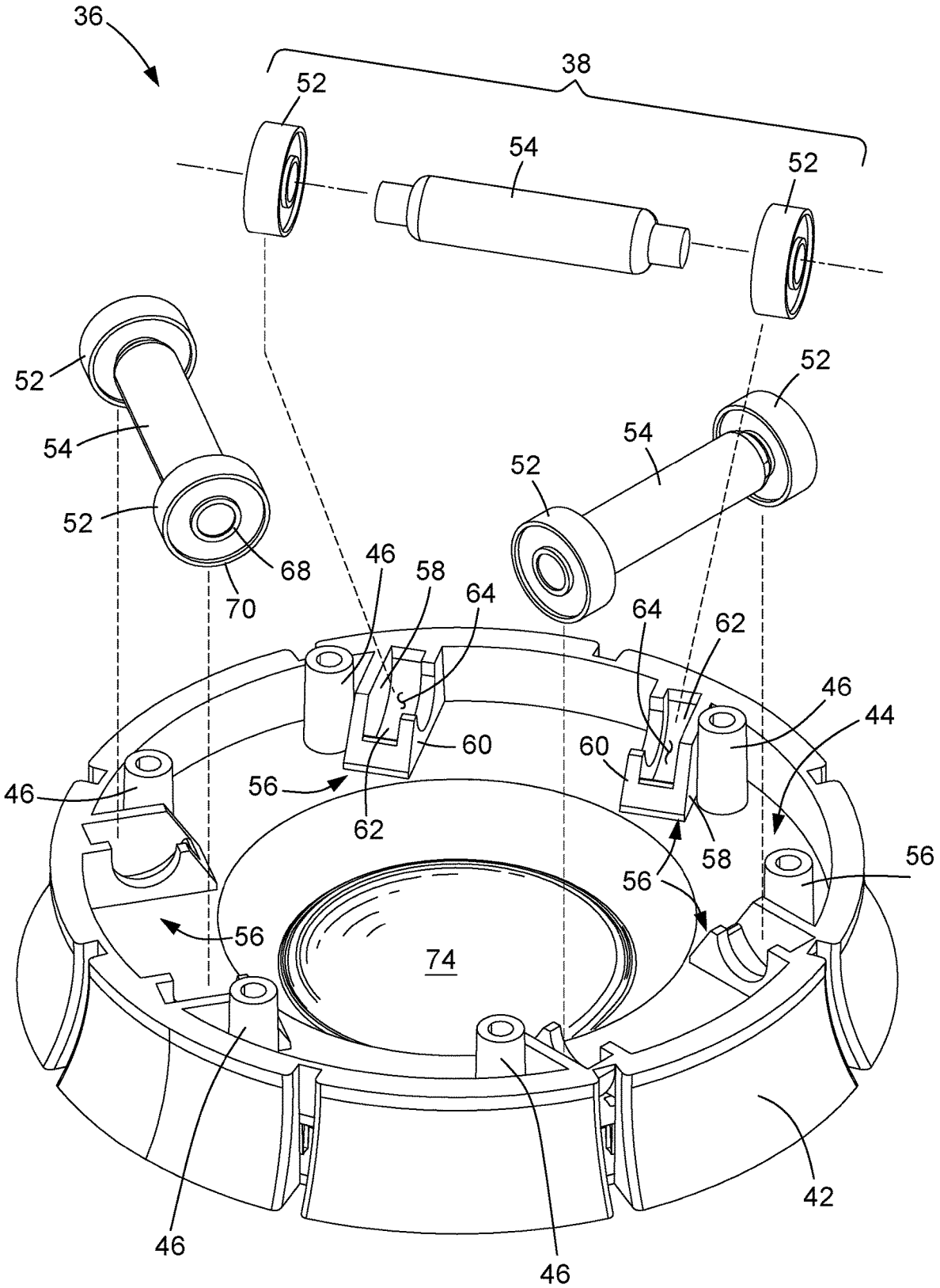
FIG. 8 is a partially exploded perspective view of the bearing assemblies exploded from the bearing retainer.

Referring now specifically to FIGS. 5 and 6, which are exploded views of the exercise device 10, the internal components of the exercise device 10 may include a bearing retainer 36 and a plurality of bearing assemblies 38 configured to interface with the roller 14. Enlarged views of the bearing retainer 36 are depicted in FIGS. 6 and 7. In one embodiment, the bearing retainer 36 may be an annular structure having a threaded inner wall 40, an outer wall 42, and a mounting wall 44 extending from the outer wall 42 toward the inner wall 40. The mounting wall 44 may include a lower surface which may face the roller 14, and an upper surface opposite the lower surface. A plurality of mounting columns 46 extend from the lower and upper surfaces, with each mounting column 46 defining a mounting bore, which may be used to facilitate attachment of the bearing retainer 36 to the base. In particular, a fastener 48 may extend through the mounting columns 46 and engage with corresponding mounting columns 50 on the base 12.

The bearing retainer 36 may also be configured to engage with several bearing assemblies 38, with each bearing assembly 38 generally including a pair of bearing supports 52 and a bearing axle 54 extending between the pair of bearing supports 52. In one embodiment, the bearing retainer 36 includes several bearing support mounts 56 extending from the mounting wall 44. Each bearing support mount 56 may include a lateral wall 58, an opposing medial wall 60, and a recessed surface 62 extending between the lateral wall 58 and the medial wall 60. The lateral wall 58, medial wall 60 and recessed surface 62 may collectively define a bearing support cavity 64 sized and configured to at least partially receive a bearing support 52. In the exemplary embodiment, the recessed surface 62 is arcuate and defines a radius of curvature that is complementary in shape to that of the bearing supports 52. The medial wall 60 may include a cutout or void to allow for traversal of an end portion of the bearing axle 54 through or across the medial wall 60.

The bearing supports mounts 56 may be arranged on the mounting wall 44 in corresponding pairs, with each pair being configured to engage with a single bearing assembly 38. Thus, the spacing between the bearing support cavities 64 may correspond to the spacing between the bearing supports 52 of the bearing assembly 38. Furthermore, the number and arrangement of the bearing support mounts 56 along the mounting wall 44 may correspond to the number and arrangement of the bearing assemblies 38. For instance, if three bearing assemblies 38 are included in the device 10, then the bearing retainer 36 may include three pairs of bearing support mounts 56; if four bearing assemblies 38 are included in the device 10, then the bearing retainer 36 may include four pairs of bearing supports mounts 56. It is contemplated that the bearing support mounts 56 may be evenly spaced about the mounting wall 44, such that three pairs of bearing support mounts 56 may be spaced approximately 120 degrees apart from each other, while four pairs of bearing support mounts 56 may be spaced approximately 90 degrees apart from each other.

The bearing assemblies 38 facilitate smooth movement of the roller 14 relative to the base 12. In this regard, as the roller 14 rolls over the underlying support surface, one or more bearing axles 54 may also rotate due to the operative engagement between the roller 14 and the bearing axles 54. Depending on the direction of the rotational movement of the roller 14 relative to the bearing axles 54, the roller 14 and one or more bearing axles 54 may rotate in concert with each other, while the roller 14 may slide over one or more of the remaining bearing axles 54. The rolling or sliding of the bearing axles 54 in response to certain rolling motion of the roller 14 may be different in embodiments having three bearing assemblies 38 versus embodiments having four bearing assemblies 38.

To facilitate smooth, quite rotation of the roller 14 relative to the base, the bearing axle 54 is configured to rotate relative to the bearing supports 52 to which the bearing axle 54 is attached. In one embodiment, the bearing supports 52 may be conventional skateboard bearings, although other bearings may be used without departing from the spirit and scope of the present disclosure.

The bearing axle 54 is rotatably coupled to a pair of bearing supports 52 and extends longitudinally therebetween. The configuration of the bearing axle 54 may vary from one embodiment to the next, with FIGS. 12-15 depicting several different examples of different bearing axles.

Figure 12:
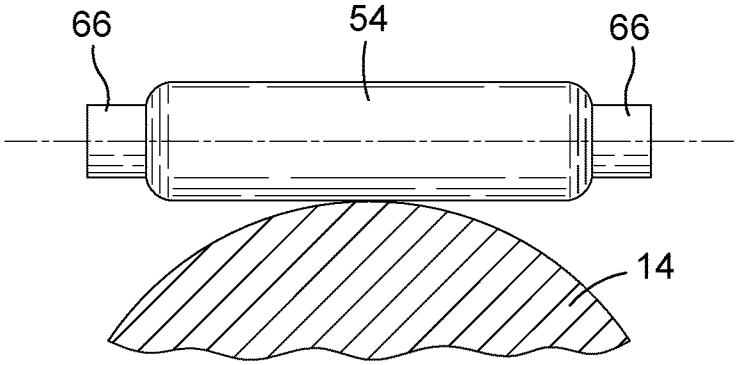
FIG. 12 is a first embodiment of a bearing axle being generally cylindrical in shape.

The bearing axle 54 depicted in FIG. 12 is a generally cylindrical bearing axle with a generally uniform outer diameter. In this regard, the diameter of the bearing axle 54 at a central portion thereof and opposed end portions thereof is relatively uniform. The bearing axle 54 may include a pair of attachment posts 66 extending from respective end portions thereof, with the attachment posts 66 being configured to engage with a respective bearing support 52. In one embodiment, the bearing support 52 includes a central ring 68 defining a central opening that receives the attachment post 66. When received within the central opening, the attachment post 66 may be frictionally engaged with the central ring 66 to facilitate engagement with the bearing support 52. In this regard, the central ring 66 of the bearing support 52 may move with the bearing axle 54, although the bearing support 52 may include an outer ring/body 70 which is moveable/rotatable relative to the central ring 66 and bearing axle 54.

Figure 13:
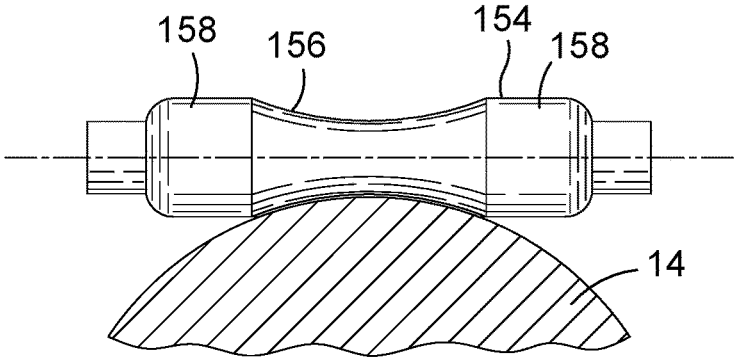
FIG. 13 is a second embodiment of a bearing axle having a middle portion that is of a reduced diameter relative to the end portions.

FIG. 13 depicts an alternative embodiment of the bearing axle 154, wherein a central portion 156 of the bearing axle 154 includes a reduced diameter relative to the pair of end portions 158. In more detail, the configuration of the bearing axle 154 is such that the pair of end portions 158 define a pair of maximum diameter regions. The reduced diameter configuration of the central portion 156 gradually transitions from the maximum diameter regions to a minimum diameter at the approximate midpoint of the bearing axle 154. In other words, the approximate midpoint of the bearing axle 154 may define a minimum diameter, with the diameter of the bearing axle 154 gradually increasing in opposite lateral directions relative to the midpoint, until reaching the maximum diameter regions at the end portions 158 of the bearing axle 154. The gradual change in the diameter in the central portion 156 may be curvilinear to define a concave configuration, which may be generally complementary in shape to the curved dimension of the outer diameter of the roller 14. The concave configuration may allow for larger contact between the roller 154 and the bearing axle 154, which may be desirable to distribute the transition of forces between the roller 14 and bearing axle 154.

Figure 14:
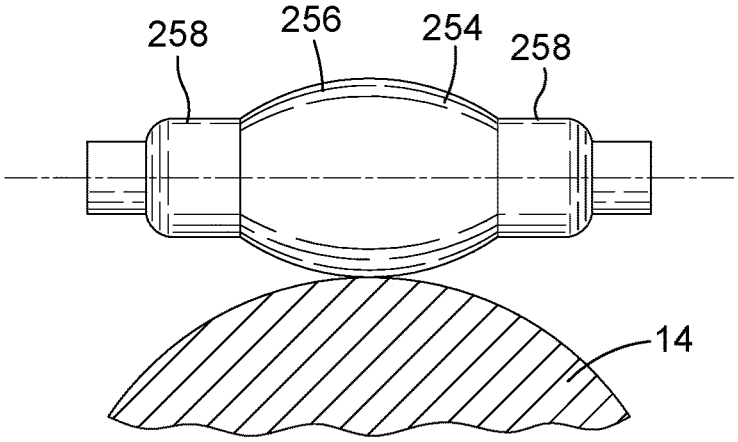
FIG. 14 is a third embodiment of a bearing axle having a middle portion that is of an enlarged diameter relative to the end portions.

Referring now to FIG. 14, there is depicted another embodiment of a bearing axle 254 having an increased diameter central portion 256 disposed between end portions 258 that are of reduced diameter. In more detail, the configuration of the bearing axle 254 is such that the pair of end portions 258 define a pair of minimum diameter regions. The increased diameter configuration of the central portion 256 gradually transitions from the minimum diameter regions to a maximum diameter at the approximate midpoint of the bearing axle 254. In other words, the approximate midpoint of the bearing axle 254 may define a maximum diameter, with the diameter of the bearing axle 254 gradually decreasing in opposite lateral directions relative to the midpoint, until reaching the minimum diameter regions at the end portions of the bearing axle 254. The gradual change in the diameter in the central portion 256 may be curvilinear to define a convex configuration or bulbous configuration. The convex configuration may allow for smaller contact between the roller 14 and the bearing axle 254, which may be desirable to minimize friction and sound therebetween.

Figure 15:
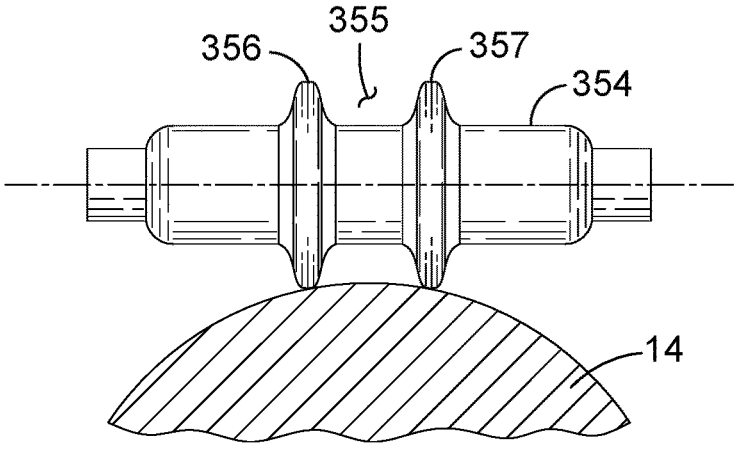
FIG. 15 is a fourth embodiment of a bearing axle having a pair of disc-like protrusions extending outwardly from a main axle body.

Referring now to FIG. 15, there is depicted yet another embodiment of the bearing axle 354 which includes a pair of disc-like protrusions 356 separate by a slot or channel 355. In particular, the central portion includes a pair of increased diameter bodies 356, each shaped like a disc, protruding radially outward from a reduced diameter section. Thus, the increased diameter bodies 356 define a maximum diameter relative to the remainder of the bearing axle 354. The size and separation of the increased diameter bodies 356 may allow the increased diameter bodies 356 to both contact the roller 14 at the same time. The configuration of the enlarged bodies 356 separated by the channel may allow for self-cleaning of the roller 14.

The outer surface of the bearing axle, in any configuration, may have a case hardened and mirror finish to create a smooth surface, which allows for smooth, quiet movement of the roller 14 relative to the base 12. However, other finishes known in the art may also be used without departing from the spirit and scope of the present disclosure.

It is contemplated that the device 10 may also include a brake to facilitate selective restricted movement of the roller 14. The brake may include a brake lever 72 and a brake body 74 operatively coupled to the brake lever 72. As shown in FIG. 1, the base 12 may include a recess 73 and the brake lever 72 (e.g., brake actuator) may be located within the recess 73. The brake body 74 may include a braking surface 75 and an externally threaded sidewall 76 that interfaces with the internally threaded surface 40 on the bearing retainer 36. The braking surface 75 is configured to be selectively placeable in contact, or in spaced relation to the roller 14, depending on the desire to either apply or braking force or not apply a braking force. When the braking surface 75 is in contact with the roller 14, the braking surface 75 applies a friction force to the roller 14 to inhibit movement of the roller 14, and when the braking surface 75 is spaced from the roller 14, no friction force may be applied on the roller 14 by the braking surface 75. The brake lever 72 is operatively coupled to the brake body 74 to facilitate selective positioning of the brake body 74 relative to the roller 14. In one embodiment, the brake lever 72 is pivotable relative to the base 12 and the bearing retainer 36, such that pivoting of the brake lever 72 in a first pivot direction causes the brake body 74 to rotate relative to the bearing retainer 36 in a first rotational direction. Conversely, pivoting of the brake lever 72 in a second pivot direction causes the brake body 74 to rotate relative to the bearing retainer 36 in a second rotational direction. The threaded interconnection between the brake body 74 and the bearing retainer 36 may allow the brake body 74 to translate axially relative to the bearing retainer 36 in response to rotational movement of the brake body 74 relative to the bearing retainer 36. Thus, rotational movement of the brake body 74 in the first rotational direction may result in first axial movement of the brake body 74 relative to the bearing retainer 36, and rotational movement of the brake body 74 in the second rotational direction may result in opposing second axial movement of the brake body 74 relative to the bearing retainer 36. Thus, by pivoting the brake lever 72, the user may selectively apply/remove the friction force between the brake body 74 and the roller 14. In some embodiments, the brake lever 72 may be pivoted to not only apply the braking force, but also to adjust the magnitude of the braking force.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. An exercise device comprising:

a base having a user engagement portion including a planar upper surface extending within an upper plane and configured to support a user while standing thereon;

a plurality of bearing assemblies operatively coupled to the base, each bearing assembly of the plurality of bearing assemblies including:

a pair of bearing supports; and a bearing axle extending between the pair of bearing supports and being coupled to the pair of bearing supports so as to facilitate rotation of the bearing axle relative to the base; and a roller operatively interfacing each bearing axle of the plurality of bearing assemblies, the roller being spaced from the upper plane and configured to rotate relative to the base.

2. The exercise device recited in claim 1, further comprising a bearing retainer coupled to the base and configured to be engageable with the plurality of bearing assemblies.

3. The exercise device recited in claim 1, wherein the plurality of bearing assemblies includes three bearing assemblies equally spaced apart from each other.

4. The exercise device recited in claim 1, wherein the plurality of bearing assemblies includes four bearing assemblies, equally spaced apart from each other.

5. The exercise device recited in claim 1, wherein each bearing axle is cylindrical with a generally uniform outer diameter.

6. The exercise device recited in claim 1, wherein each bearing axle includes a pair of end portions and a central portion, with the central portion having a reduced diameter relative to the pair of end portions.

7. The exercise device recited in claim 1, wherein each bearing axle includes a pair of end portions and a central portion, with the central portion having an increased diameter relative to the pair of end portions.

8. The exercise device recited in claim 1, wherein each bearing axle includes a pair of end portions and a central portion, the central portion include a pair of increased diameter bodies protruding radially outward from an intermediate reduced diameter section.

9. The exercise device recited in claim 1, wherein the base includes a roller retaining wall, the user engagement portion including a main wall extending radially outward from the roller retaining wall, the base and the roller being configured such that at least a majority of the roller is positioned between the main wall and a distal most portion of the roller extending away from the main wall.

10. The exercise device recited in claim 1, further comprising a brake and a brake actuator, the brake being operatively engageable with the roller and configured to selectively impart a force on the roller to inhibit movement of the roller relative to the base, the brake actuator being manually controllable and configured to facilitate movement of the brake relative to the base.

11. An exercise device comprising:

a base disposed about a central axis and having an outer periphery circumnavigating the central axis and a recess;

a plurality of bearing axles configured to be rotatable relative to the base, each bearing axle of the plurality of bearing axles having an elongate configuration and extending along a respective axle axis;

a roller operatively interfacing each bearing axle of the plurality of bearing axles, the roller being configured to;

a brake operatively engageable with the roller and configured to selectively impart a force on the roller to inhibit movement of the roller relative to the base; and a brake actuator located within the recess and configured to be manually controllable and to facilitate movement of the brake relative to the roller;

the outer periphery being of a maximum magnitude within a plane spaced from the roller.

12. The exercise device recited in claim 11, further comprising a bearing retainer coupled to the base and configured to facilitate interconnection of the plurality of bearing axles to the base.

13. The exercise device recited in claim 11, wherein the plurality of bearing axles include three bearing axles.

14. The exercise device recited in claim 11, wherein the plurality of bearing axles include four bearing axles.

15. The exercise device recited in claim 11, wherein each bearing axle of the plurality of bearing axles is cylindrical with a generally uniform outer diameter.

16. The exercise device recited in claim 11, wherein each bearing axle includes a pair of end portions and a central portion, with the central portion having a reduced diameter relative to the pair of end portions.

17. The exercise device recited in claim 11, wherein each bearing axle includes a pair of end portions and a central portion, with the central portion having an increased diameter relative to the pair of end portions.

18. The exercise device recited in claim 11, wherein each bearing axle includes a pair of end portions and a central portion, the central portion include a pair of increased diameter bodies protruding radially outward from an intermediate reduced diameter section.

19. The exercise device recited in claim 11, wherein a portion of the roller is concealed within the base while a remaining portion extends from the base.

20. An exercise device comprising:

a base;

a plurality of bearing axles configured to be rotatable relative to the base, each bearing axle of the plurality of bearing axles having an elongate configuration and extending along a respective axle axis;

a roller operatively interfacing each bearing axle of the plurality of bearing axles, the roller being configured to;

a brake operatively engageable with the roller and configured to selectively impart a force on the roller to inhibit movement of the roller relative to the base; and a brake actuator configured to be manually controllable and to facilitate movement of the brake relative to the roller;

wherein the base includes a recess and the brake actuator is located within the recess.

* * * * *